US007278281B2

(12) United States Patent
Yang et al.

(10) Patent No.: US 7,278,281 B2
(45) Date of Patent: Oct. 9, 2007

(54) METHOD AND APPARATUS FOR REDUCING C2 AND C3 AT LNG RECEIVING TERMINALS

(75) Inventors: Chi-Cheng Yang, Sugar Land, TX (US); Alard Kaplan, Houston, TX (US); Zupeng Huang, Pearland, TX (US)

(73) Assignee: Foster Wheeler USA Corporation, Houston, TX (US)

( * ) Notice: Subject to any disclaimer, the term of this patent is extended or adjusted under 35 U.S.C. 154(b) by 257 days.

(21) Appl. No.: 10/987,297

(22) Filed: Nov. 15, 2004

(65) Prior Publication Data

US 2005/0155381 A1 Jul. 21, 2005

Related U.S. Application Data

(60) Provisional application No. 60/519,267, filed on Nov. 13, 2003.

(51) Int. Cl.
*F25J 1/00* (2006.01)
*F25J 3/00* (2006.01)

(52) U.S. Cl. ..... 62/612; 62/620

(58) Field of Classification Search ..... 62/611, 62/612, 620
See application file for complete search history.

(56) References Cited

U.S. PATENT DOCUMENTS 3,420,068 A * 1/1969 Petit ..... 62/623
3,656,312 A * 4/1972 Streich ..... 62/630
5,114,451 A 5/1992 Rambo et al.
5,359,856 A 11/1994 Rhoades et al.
5,390,499 A * 2/1995 Rhoades et al. ..... 62/614
6,564,579 B1 * 5/2003 McCartney ..... 62/620
6,662,589 B1 * 12/2003 Roberts et al. ..... 62/425
6,907,752 B2 * 6/2005 Schroeder et al. ..... 62/620
7,069,743 B2 * 7/2006 Prim ..... 62/620
2005/0218041 A1 * 10/2005 Yoshida et al. ..... 208/340

OTHER PUBLICATIONS

S. Huang et al., "Select the Optimum Extraction Method for LNG Regasification", Hydrocarbon Processing, Jul. 2004, pp. 57-62.
Daniel R. Rogers, "Gas 'Interchangeability' And Its Effects On U.S. import Plans", Pipeline & Gas Journal, Aug. 2003, 18-28.
Daniel R. Rogers, "Long-term Solution Needed to Embrace Imports with Pipeline Gas", Pipeline & Gas Journal, Sep. 2003, pp. 14-22.
C.C. Yang et al., "Cost-effective design reduces C2 and C3 at LNG Receiving Terminals", Oil & Gas Journal, 2003.
California Air Resources Board, Specifications for Compressed Natural Gas, Board Administration and Regulatory Coordination Unit, Division 3, Chapter 5, Article 3, §2292.5.

* cited by examiner

*Primary Examiner*—William C Doerrler
(74) *Attorney, Agent, or Firm*—Paul Davis; Heller Ehrman LLP

(57) ABSTRACT

A liquefied natural gas (LNG) receiving terminal is provided, including an extraction column adapted and configured to separate a $C_1$ component from other components in a LNG stream into a $C_1$ rich stream, one of a gas condenser and a heat exchanger adapted and configured to condense the $C_1$ rich stream into a liquid, and a pump adapted and configured to increase a pressure of the liquid $C_1$ rich stream.

21 Claims, 2 Drawing Sheets

METHOD AND APPARATUS FOR REDUCING C2 AND C3 AT LNG RECEIVING TERMINALS

CORRESPONDING RELATED APPLICATIONS AND PUBLICATIONS

The present invention claims the benefit of and priority to U.S. Provisional Patent Application No. 60/519,267 filed Nov. 13, 2003, the entire contents of which is incorporated by reference herein in its entirety. Additionally, the present invention incorporates by reference the entire contents of "Cost-Effective Design Reduces C2 And C3 At LNG Receiving Terminals" (The Oil & Gas Journal, May 2003).

ing LNG baseload plants. Exemplary pipeline specifications (Table 1) and LNG baseload plant outputs (Table 2) are provided below.

TABLE 1

Exemplary Pipeline Specifications

| Component, wt % | California Air Minimum | Resources Board CNG Maximum | Mexicon Natural Gas Maximum |
|---|---|---|---|
| Methane ($C_1$) | 88 | | |
| Ethane ($C_2$) | | 6 | |
| Propane ($C_3$+) | | 3 | 3.6 |

TABLE 2

Exemplary LNG Baseload Output

| Component wt % | Das Island, Abu Dhabi | Whitnell Bay, Australia | Bintulu Malaysia | Arun, Indonesia | Lumut, Brunei | Botang, Indonesia | Ras Laffan, Qatar |
|---|---|---|---|---|---|---|---|
| Methane ($C_1$) | 87.10 | 87.80 | 91.20 | 89.20 | 89.40 | 90.60 | 89.60 |
| Ethane ($C_2$) | 11.40 | 8.30 | 4.28 | 8.58 | 6.30 | 6.00 | 6.25 |
| Propane ($C_3$) | 1.27 | 2.98 | 2.87 | 1.67 | 2.80 | 2.48 | 2.19 |
| Butane ($C_4$) | 0.141 | 0.875 | 1.36 | 0.511 | 1.30 | 0.82 | 1.07 |
| Pentane ($C_5$) | 0.001 | — | 0.01 | 0.02 | — | 0.01 | 0.04 |

BACKGROUND OF THE INVENTION

1. Field of the Invention

The present invention relates generally to liquefied natural gas (LNG) terminals, and more particularly to LNG receiving terminals.

2. Background of the Invention

LNG is the liquid state of the same natural gas as used for gas-fired appliances in domestic households and industries, for pipeline sendout, and for electricity generation in gas-fired power plants. While natural gas in its gaseous state is used for domestic and commercial applications, when natural gas is transported from production locations to usage locations over long distances it is usually transported in a liquid state because LNG is about six hundred times smaller in volume than in its gaseous state. This significant reduction in volume makes LNG considerably less expensive than gaseous natural gas to transport over long distances. Hence, many LNG supply networks subject natural gas to liquefying at a production location, transporting between the production location and a usage location, and finally re-gasifying at the usage location prior to distribution to a consumer.

Different natural gas consumers, however, have different requirements for the LNG being re-gasified, such as varying calorific value and/or quality requirements. In order to satisfy different customer requirements, gas companies set strict requirements on the composition of the natural gas sent out of their LNG receiving terminals. These requirements vary from one LNG buyer to another, and often include Ethane ($C_2$), Propane ($C_3$) and heavier components content specifications that are lower than LNG production at existing LNG baseload plants. Exemplary pipeline specifications (Table 1) and LNG baseload plant outputs (Table 2) are provided below.

In many instances, LNG baseload plants cannot be efficiently modified so as to meet the varying specifications. This inflexibility is due, in part, to the configuration and equipment used in typical LNG baseload plants. Specifically, after an initial feed-gas treatment (e.g., acid-gas removal, dehydration, mercury removal, etc.), LNG baseload plants typically remove components from the LNG using a scrub column. As an example, benzene and $C_5$ components may be removed from the LNG to prevent the LNG from freezing in a main cryogenic heat exchanger. Further, $C_2$ components may be removed from the LNG to control the calorific value. Hence, many LNG baseload plants would have to modify the scrub column or alter its operation to satisfy the noted customer requirements.

The scrub columns at many baseload plants, however, cannot be effectively modified to satisfy customer requirements because doing so would reduce the operating pressure of feed gas entering the main cryogenic heat exhanger to unacceptable levels. Specifically, the feed-gas pressure for most baseload LNG plants is greater than 60 bara. If the plant must remove heavier hydrocarbon components to meet a typical North American market calorific value (e.g., about 1,070 btu/cu ft), the scrub column must operate at a pressure of about 40 bara based on the critical pressure of the feed gas. The critical pressure is "critical" because the separation process becomes difficult and very inefficient near the critical pressure while the refrigerant efficiency depends on the operating pressure of feed gas entering the main cryogenic heat exchanger. A lower calorific value, therefore, would require recompression of feed gas from the scrub column to the main cryogenic heat exchanger, which is significantly more expensive. As such, a need exists for a method and apparatus for reducing the amount of various components (e.g., $C_2$ and/or $C_3$+) without raising costs to prohibitive levels.

Other problems with the prior art not described above can also be overcome using the teachings of the present invention, as would be readily apparent to one of ordinary skill in the art after reading this disclosure.

DETAILED DESCRIPTION OF THE EXEMPLARY EMBODIMENTS

Reference will now be made in detail to exemplary embodiments of the present invention. Wherever possible, the same reference numbers will be used throughout the drawings to refer to the same or like parts.

According to one embodiment of the present invention, imported LNG with excessive heavy components (i.e., $C_2$+ components) is provided as a LNG stream 100 fed into to a LNG receiving terminal. As an example, the LNG stream 100 may contain: 87 mole % $C_1$, 11.4 mole % $C_2$, 1.3 mole % $C_3$, and some additional heavier components. This example LNG composition is used below to illustrate various aspects of the present embodiment. Other compositions are also contemplated.

Figure 1:
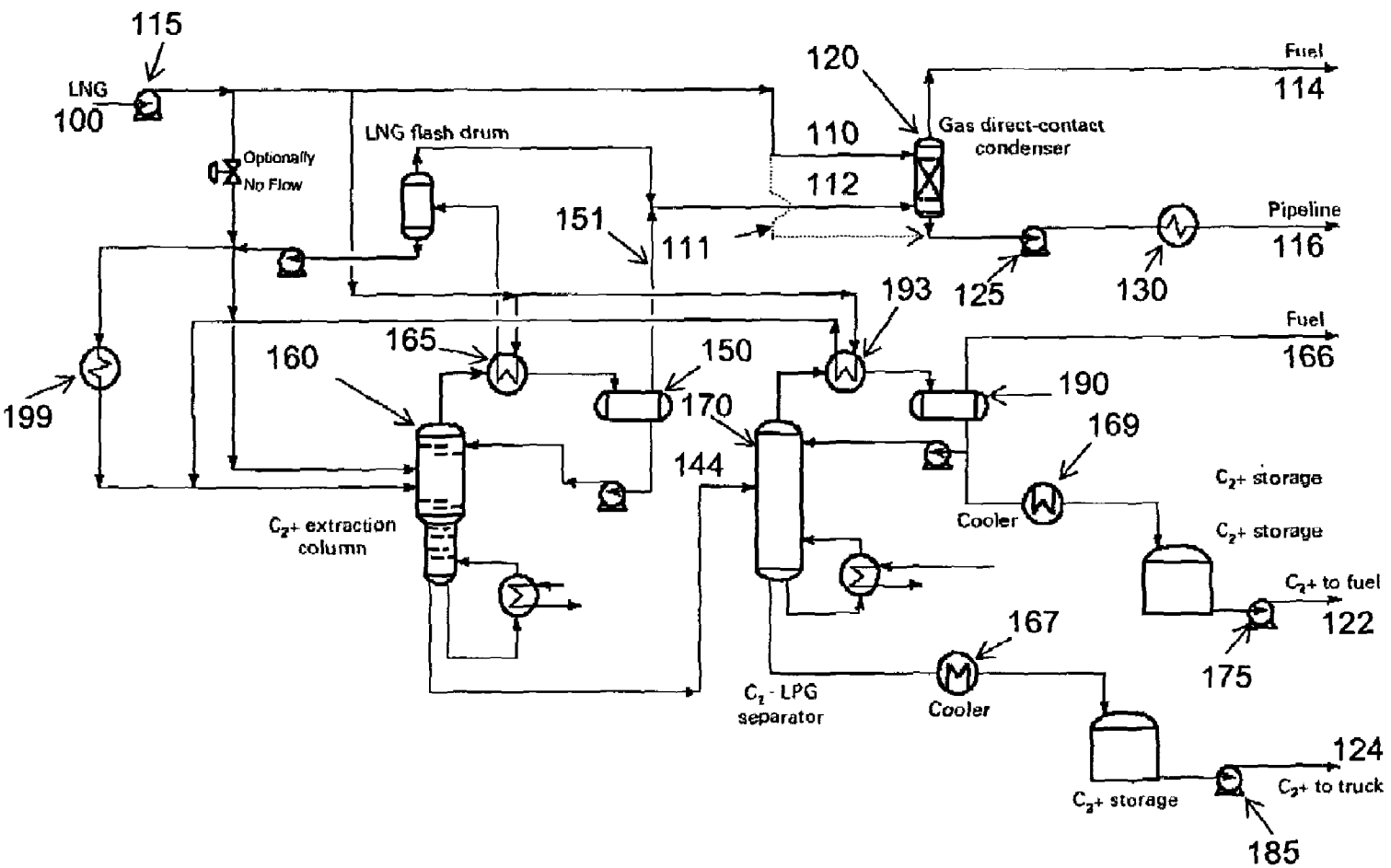
FIG. 1 depicts a receiving terminal according to an embodiment of the present invention.

According to one embodiment of the present invention as shown in FIG. 1, the LNG receiving terminal includes a fractionation section adapted and configured to process LNG stream 100. In particular, the LNG receiving terminal separates out the excessive heavy components within the LNG stream 100 to form a lean/$C_1$ rich LNG stream, and liquefies/condenses the lean LNG stream 116 to facilitate pumping via pump 125. Lean LNG stream 116 may, for example, contain less than about 6 mole % $C_2$ and/or less than about 3 mole % $C_3$+ based on the noted composition of LNG, i.e., greater than a 5 mole % reduction in $C_2$. This lean LNG stream 116 satisfies many low level requirements as to at least the $C_2$ content, and can then be pumped to the vaporizer 130 with pump 125 for distribution to various consumers.

In some embodiments, the fractionation section may process only a portion of the LNG stream 100 as pumped by pump 115. As an example, the fractionation section may process about half of the LNG stream 100. The portion of the LNG stream 100 not processed by the fractionation section may serve as a coolant and/or a mixing component. Additionally, optional bypass 111 may or may not be provided to bypass part of the LNG stream 100. These uses are described in greater detail below.

According to one embodiment of the present invention, the LNG stream 100 can be used as a coolant for coolers 165, 167, 169, and/or 193. Using the LNG stream 100 as a coolant reduces system operating costs as the LNG stream 100 is typically relatively cold as supplied to the system. Further, the LNG stream 100 itself is already being supplied to the system for processing. Thus, additional coolants do not have to be procured and stored. Of course, alternative coolants such as liquid nitrogen could also be used.

According to one embodiment of the present invention, the LNG stream 100 can be used as a mixing component in gas direct-contact condenser 120. Though similarly a gas indirect-contact condenser could also be used. As shown, the LNG stream 100 is split between the $C_2$ extraction column 160 and the gas direct-contact condenser 120. Overhead vapor from the $C_2$ extraction column 160 is partially condensed in condenser/cooler 165 and sent to flash drum 150. Optionally, flash drum 150 lowers a pressure of the overhead vapor to enhance vaporization of dissolved gases in the $C_1$ rich stream 112. The flash gas stream 151 from flash drum 150 is then fed into gas direct-contact condenser 120, where it is mixed with LNG stream 100 to produce a warm condensed LNG. The condensed LNG is then pumped with pump 125 to vaporizer 130 for distribution as lean LNG stream 116. Any overhead gas from the gas direct-contact condenser may be exhausted as fuel 114 for various uses.

As described above, gas direct-contact condenser 120 uses, as a cooling medium 110, the LNG stream 100 to condense the $C_1$ rich stream 112 from the $C_2$ extraction column 160 to produce the lean LNG stream 116. It should be appreciated that other coolants could also be used depending on the type of gas condenser, such as liquid nitrogen. Moreover, other condensing means such as a heat exchanger could also be used with or without using LNG stream 100 as a coolant. Such variations are all considered to be within the spirit and scope of the present invention.

The present embodiment successfully eliminates the need for gas compressors (though they may still be used for various processes) because it uses a gas direct-contact condenser 120 or other condensing means. This reduces system building and operating costs. In addition to lower cost advantages, the present embodiment may achieve a lean LNG stream with not more than about 6 mole % $C_2$. Such an output is a marked improvement over conventional LNG terminals. Other advantages and features of the present invention will also become apparent upon reading this disclosure and practicing various embodiments of the present invention.

According to another embodiment of the present invention, the fractionation section is adapted and configured to provide liquid ethane gas (LEG) 122 and/or liquid propane gas (LPG) 124 for use such as export or fuel. To provide this capability, the fractionation section may include two or more fractionation columns: a $C_2$ extraction column 160 (as previously discussed) and a $C_2$-LPG separator 170 (a second extraction column). This process and the operation of extraction columns 160, 170 is discussed in greater detail below.

The $C_2$ extraction column 160 receives vaporized LNG from the LNG vaporizer 199 and liquid LNG from the LNG feed pump 115. Preferably, the liquid LNG from the LNG feed pump 115 is supplied to one or more column overhead condensers within the $C_2$ extraction column 160. These column overhead condensers may include one of a plate-and-fin type exchanger(s) and a shell-and-tube type exchanger(s) as are well known in the art. Using the column overhead condensers, the $C_2$ extraction column 160 (a first extraction column) produces the $C_1$ rich stream 112 as previously discussed. According to the present embodiment, the $C_2$ extraction column 160 is also configured to produce a first $C_2$ rich stream 144.

In operation, the first $C_2$ rich stream 144 is provided to the $C_2$-LPG separator 170, which produces an LPG stream (a condensed $C_3$ stream) from the bottoms (sent to cooler 167) and a $C_2$ cut (a condensed $C_2$ stream) from the overhead (sent to cooler 193). $C_2$-LPG separator 170 may be of a packed bed or tray column type as are well known in the art. Other configurations are also contemplated.

The $C_2$ cut may be provided to flash drum 190. Flash gas from the flash drum 190 may be sent out as fuel 166 for plant operation or the like. The lean ethane gas, however, is preferably provided to cooler 169 and stored in a tank or distributed as LEG 122 via pump 175. In this manner, the system may be capable of providing lean LEG 122 as well as lean LNG 116.

The LPG stream may be provided to cooler 167 and stored in a tank or distributed as LPG 124 via pump 185. In this manner, the system may be capable of providing lean LPG 124 as well as lean natural gas.

While the present embodiment shows marked improvement over conventional designs, the exact amount of cold feed LNG that the fractionation section processes (roughly 50%) typically depends on the required $C_2$ specification and the extraction column operating requirements. The $C_2$ extraction column 160 usually operates at between about 20 barg to about 50 barg. A lower operating pressure improves separation efficiency, but also increases column size and reduces the fractionation column overhead vapor condensing. The pressure setting must be less than the system critical pressure needed to achieve separation. The $C_2$-LPG separator 170 usually operates at about 20 bara. Other configurations are also contemplated.

Figure 2:
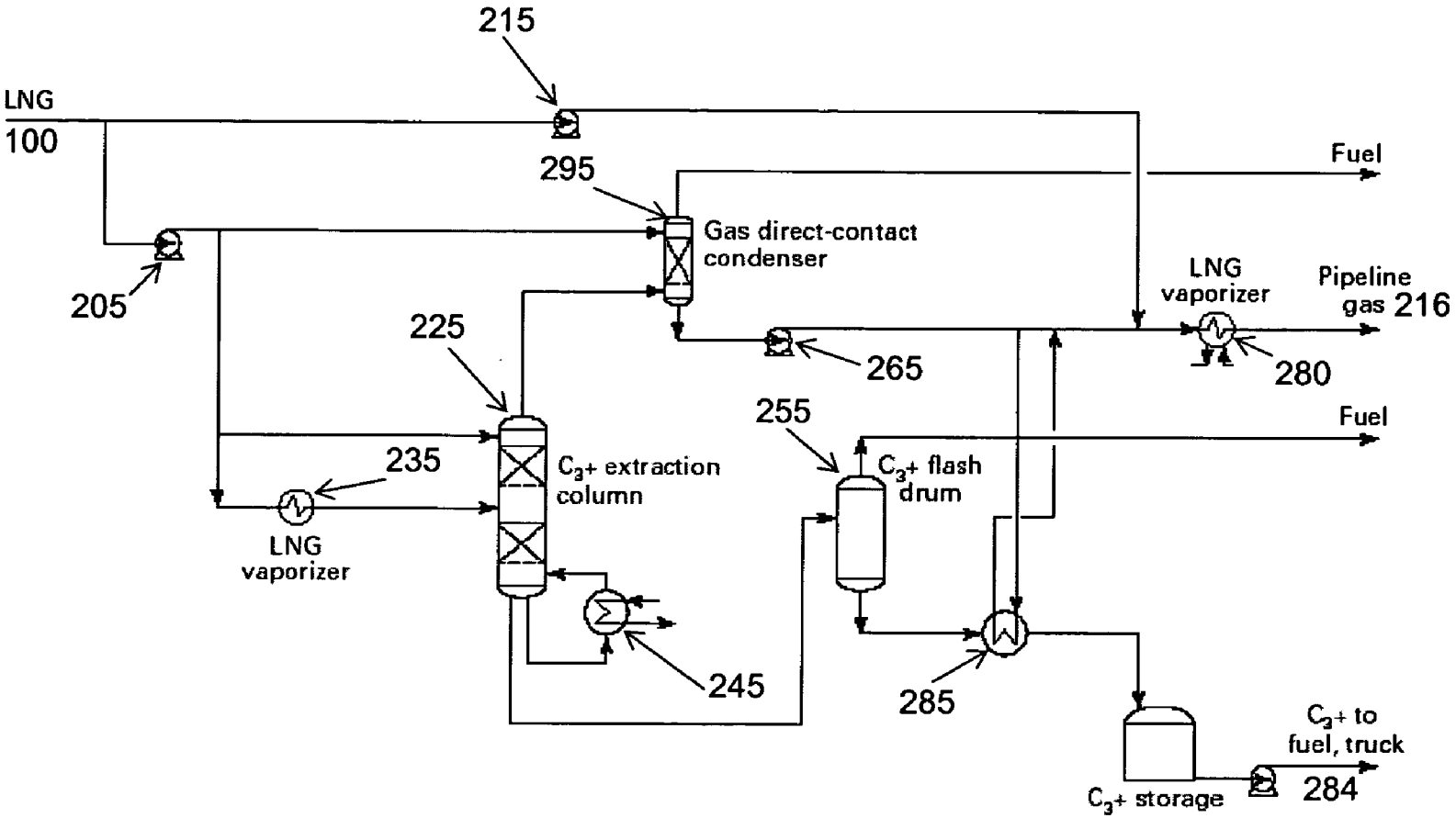
FIG. 2 depicts a receiving terminal according to another embodiment of the present invention.

According to another embodiment of the present invention as shown in FIG. 2, a LNG receiving terminal is provided with a $C_3$ extraction section for providing a lean LPG 284. As an example, the $C_3$ extraction section processes about 19% of the supplied LNG 100. The process gas then mixes with the by-passed gas to meet the sendout gas specification.

Within the $C_3$ extraction section, as an example a $C_3$ extraction column 225 may be provided for processing about 8% of the supplied LNG 100 fed to the $C_3$ extraction section. The remaining 11% of the supplied LNG 100 preferably enters the gas direct-contact condenser 295 for use as an absorbent and/or coolant. Operation of the $C_3$ extraction column 225 and gas direct-contact condenser 295 is discussed in greater detail below.

The $C_3$ extraction column 225 may include at least one packed-bed extraction column. Approximately 30% of the LNG that enters $C_3$ extraction column 225 may feed directly to the top as an absorbent. The other 70% first goes to LNG vaporizer 235 which vaporizes the LNG, the vapor then entering the $C_3$ extraction column 225 between the two packed beds as shown and directly enters the column 225. The $C_3$ extraction column 225 separates $C_3$ components from the LNG stream 100 into overhead vapor and a $C_3$ stream.

The overhead vapor may be a lean $C_1$ stream analogous to $C_1$ rich stream 112 in FIG. 1. As such, operation of gas-direct contact condenser 295, pump 265, LNG vaporizer 280, and lean LNG 216 is analogous to components 120, 125, 130 and 116 respectively. Variations are also contemplated.

The $C_3$ stream flows to the $C_3$ flash drum 255, in which light components flash to the top. The $C_3$ stream from the bottom of the flash drum 255 first depressurizes to atmospheric pressure, is cooled with cold LNG, and feeds to the $C_3$ storage tanks. Liquid from the direct-contact condenser 295 is pumped via pump 265 to pipeline required pressure of about 80 barg to about 140 barg, and flows through LNG vaporizer 280 to the export gas pipeline.

The $C_3$ extraction column 225 operating pressure is preferably about 20 barg to about 50 barg. A lower operating pressure improves separation efficiency, but increases column size. According to one aspect of the present invention, four theoretical stages are provided between the liquid and vapor feed and three stages between the vapor feed and bottoms for the $C_1$ and $C_3$ separation. Of course, other numbers of theoretical stages could also be used.

In the extraction column, 90% of the $C_3$ flows to the column bottoms, which contains no more than 10 mole % of $C_1$. Vapor leaving the $C_3$ extraction column 225 is recondensed when mixed with cold LNG in the gas direct-contact condenser. To ensure that the condensed liquid is easily pumped with pump 265, cold LNG flow to the gas direct-contact condenser 295 is at least 20% more than vapor flow.

Preferably, LNG mixes in gas direct-contact condenser 295 with overhead vapor from the $C_3$ extraction column 225. The overhead vapor may be a $C_1$ rich stream analogous to $C_1$ rich stream 112 discussed in reference to FIG. 1. This C1 rich stream may be mixed with the LNG stream 100 in gas direct-contact condenser 295 to produce lean LNG 216 To ensure that condensed liquid stays in the liquid phase, LNG leaving the direct-contact condenser 295 may be sub-cooled at least 5 deg. C. The subcooling requires about 11% of the cold pumpout LNG to recon-dense and refrigerate the extractor overhead vapor. Condensed LNG is pumped up to pipeline required pressure, regasified in LNG vaporizer 280, and sent to the gas pipeline.

The foregoing description of various embodiments of the invention has been presented for purposes of illustration and description. It is not intended to be exhaustive or to limit the invention to the precise form disclosed, and modifications and variations are possible in light of the above teachings or may be acquired from practice of the invention. As an example, while the present invention discloses various embodiments as used in a LNG receiving terminal, similar components could also be implemented at a baseload plant. Hence, the embodiments were chosen and described in order to explain the principles of the invention and its practical application to enable one skilled in the art to utilize the invention in various embodiments and with various modifications as are suited to the particular use contemplated.

What is claimed is:

1. A liquefied natural gas (LNG) receiving terminal, comprising:

an extraction column adapted and configured to separate a $C_1$ component from other components in a LNG stream into a $C_1$ rich stream;

a gas condenser adapted and configured to condense the $C_1$ rich stream into a liquid, wherein the gas condenser uses less than about 50% of the LNG stream as a coolant; and a pump adapted and configured to increase a pressure of the liquid $C_1$ rich stream.

2. The LNG receiving terminal of claim 1, wherein the terminal includes one of a gas direct-contact condenser and a gas indirect-contact condenser.

3. The LNG receiving terminal of claim 1, wherein a ratio of the LNG stream used as the coolant in the gas condenser versus the LNG stream processed by the extraction column is selected based on a composition of the LNG stream and a quality specification for a processed sendout gas stream.

4. The LNG receiving terminal of claim 2, wherein the terminal includes the gas indirect-contact condenser, and wherein the gas indirect-contact condenser uses liquid nitrogen as a coolant.

5. The LNG receiving terminal of claim 1, wherein the terminal includes the heat exchanger.

6. The LNG receiving terminal of claim 5, wherein the heat exchanger uses the LNG stream as a coolant.

7. The LNG receiving terminal of claim 5, wherein the heat exchanger uses liquid nitrogen as a coolant.

8. The LNG receiving terminal of claim 1, wherein the $C_1$ rich stream includes less $C_2$ than the LNG stream.

9. The LNG receiving terminal of claim 8, wherein the $C_1$ rich stream includes less than about 6 mole % $C_2$.

10. The LNG receiving terminal of claim 1, wherein the $C_1$ rich stream includes less $C_3$+ than the LNG stream.

11. The LNG receiving terminal of claim 10, wherein the $C_1$ rich stream includes less than about 3 mole % $C_3$+.

12. The LNG receiving terminal of claim 1, further comprising:

a vaporizer adapted and configured to vaporize the liquid $C_1$ rich stream into a processed $C_1$ stream, wherein the pump pumps the liquid $C_1$ rich stream to the vaporizer.

13. The LNG receiving terminal of claim 1, wherein an operating pressure of the extraction column is in the range of about 20 barg to about 50 barg.

14. The LNG receiving terminal of claim 1, wherein the terminal is free of sendout gas pressurizing compressors.

15. A method of separating components in a liquefied natural gas (LNG) stream at a receiving terminal, comprising:

separating a $C_1$ component from other components in the LNG stream into a $C_1$ rich stream;

condensing the $C_1$ rich stream into a liquid $C_1$ rich stream, wherein condensing the $C_1$ rich stream comprises mixing the $C_1$ rich stream with the LNG stream; and pumping the liquid $C_1$ rich stream to increase a pressure of the liquid $C_1$ rich stream.

16. The method of claim 15, further comprising:

altering an amount of the LNG stream mixed with the $C_1$ rich stream to achieve a quality specification for the liquid $C_1$ rich stream.

17. The method of claim 15, wherein condensing the $C_1$ rich stream comprises passing the $C_1$ rich stream through a heat exchanger.

18. The method of claim 15, further comprising vaporizing the liquid $C_1$ rich stream into a processed $C_1$ stream.

19. A liquefied natural gas (LNG) receiving terminal, comprising:

means for separating a $C_1$ component from other components in a LNG stream into a $C_1$ rich stream;

means for condensing the $C_1$ rich stream into a liquid $C_1$ rich stream, wherein the means for condensing includes means for mixing the $C_1$ rich stream with the LNG stream;

and means for increasing a pressure of the liquid $C_1$ rich stream.

20. The LNG receiving terminal of claim 19, further comprising:

means for altering an amount of the LNG stream mixed with the $C_1$ rich stream to achieve a quality specification for the liquid $C_1$ rich stream.

21. The LNG receiving terminal of claim 19, wherein the means for condensing includes means for exchanging heat with a coolant without mixing the coolant with the $C_1$ rich stream.

* * * * *